US008261370B2

(12) United States Patent
Elahi et al.

(10) Patent No.: US 8,261,370 B2
(45) Date of Patent: Sep. 11, 2012

(54) COLLAR SUPPORT MEMBER WITH FASTENING MEANS

(76) Inventors: Ebrahim Elahi, New York, NY (US); Keivan Edward Razavi, New York, NY (US)

( * ) Notice: Subject to any disclaimer, the term of this patent is extended or adjusted under 35 U.S.C. 154(b) by 2006 days.

(21) Appl. No.: 10/842,960

(22) Filed: May 11, 2004

(65) Prior Publication Data

US 2005/0251892 A1 Nov. 17, 2005

(51) Int. Cl.
*A41B 3/00* (2006.01)

(52) U.S. Cl. ..... 2/129

(58) Field of Classification Search ..... 2/60, 129, 2/132, 134, 136, 155, 156, 255, 258, 131, 2/133, 137; 223/83, 84, 71, 66, 68, 81, 82
See application file for complete search history.

(56) References Cited

U.S. PATENT DOCUMENTS 1,083,826 A * 1/1914 Graubarth ..... 2/132
2,508,126 A * 5/1950 Turner ..... 2/132
2,519,380 A 8/1950 Kohl et al.
2,562,519 A * 7/1951 Ashley ..... 2/132
2,610,774 A 9/1952 Calder
3,760,994 A * 9/1973 Taimisto ..... 223/83
3,865,286 A * 2/1975 Tiss ..... 223/83
4,133,463 A 1/1979 Bourrian
4,286,337 A 9/1981 Malouf, Jr.
5,360,148 A 11/1994 Goscin et al.
6,889,387 B1 * 5/2005 Tiss et al. ..... 2/60

* cited by examiner

*Primary Examiner* — Tejash Patel

(57) ABSTRACT

The device and method according to an aspect of the present invention provides a garment collar support member for shaping a garment collar, wherein the garment collar support member comprises a first collar shaping region adapted to support a first collar associated with the garment collar, the first collar shaping region comprising a first non planar surface; a second collar shaping region adapted to support a second collar associated with the garment collar, the second collar shaping region comprising a second non planar surface; and a coupling system associated with coupling the first and second collar shaping region together for providing a housing region between the first and second non-planar surface, wherein the housing region stores at least one fastening item.

20 Claims, 10 Drawing Sheets

COLLAR SUPPORT MEMBER WITH FASTENING MEANS

FIELD OF INVENTION

The present invention relates to a support member for supporting and retaining the shape of a collar of a garment. In particular, the present invention relates to a collar support member that is adapted to store and/or secure pins and other fastening items associated with various garments.

BACKGROUND OF INVENTION

Garments in general, especially dress shirts, are often folded prior to being displayed for sale, or following the dry cleaning or laundry process. In the case of, for example, shirts that are put on sale, folded shirts are stacked or arranged in a manner which provides potential customers with an opportunity to visually select a shirt of choice. The customers may then either try on the selected shirt in a designated changing room, or alternatively, upon knowledge of their size (e.g., shirt size), proceed to buy the shirt. In either case, the shirt or garment may be folded using various fastening means, such as pins and/or other potentially sharp objects. These fastening items are used to hold various parts of a garment such as a shirt together for the purpose of facilitating the folding process. The primary objective, among others, for folding shirts using these fastening items, is to ensure that the shirt can be stored or arranged in an orderly manner, whereby efficient use of storage and display space is utilized. Also, by correctly folding a shirt or garment, it is less likely to become creased or wrinkled. In the case of dry cleaned or laundered garments (e.g., shirts), folding the shirts with various fastening means helps maintain each garment's ironed appearance, thus prohibiting it from becoming creased or wrinkled prior to a person wearing it.

Prior to trying on or deciding to wear a particular folded garment, fastening means such as pins become invariably scattered around either the dressing room floor of a store, or various locations (e.g., bedroom floor, bathroom, bed, etc.) within a person's home, as the shirt is unfolded for use. Consequently, there is a potential risk of someone stepping on these fastening items. Moreover, in addition to stepping on these items, young children may find and ingest them, further adding to the need to safely store and remove these fastening items from harms way.

It is therefore an object of the present invention to safely store fastening items as they are removed from shirts and garments.

It is yet another object of the present invention to safely store fastening items from a garment utilizing means that aid the shaping and folding of the garment from which the fastening items were removed.

It is also a further object of the present invention to provide a means for recycling fastening items associated with a garment.

SUMMARY OF INVENTION

These and other objects of the present invention, at least in part, address the long felt, but unmet needs described above, and are accomplished by a collar support device for shaping the collar of a garment having a plurality of fastening items. The collar support member comprises an elongate strip placed around the periphery of the garment collar, where the elongate strip comprises a retaining member for securing at least one of the plurality of fastening items to the elongate strip when at least one of the plurality of fastening items is removed from the garment.

In another aspect of the present invention a garment collar support member comprises a first collar shaping region adapted to support a first collar region, where the first collar shaping region comprises a first non planar surface. A second collar shaping region is provided, which is also adapted to support a second collar region, the second collar shaping region also comprising a second non planar surface. A coupling system associated with coupling the first and second collar shaping region together provides a housing region between the first and second non-planar surface, wherein the housing region stores at least one fastening item.

Another aspect of the present invention provides a method of storing at least one garment fastening item, whereby the method comprises the steps of providing a collar support member having a first and a second non-planer surface. At least one garment fastening item is inserted into a recess associated with the first non-planer surface. The second non-planer surface is then folded onto the first non-planer surface for providing a housing therebetween, wherein the garment fastening item is located in the housing.

Yet another aspect of the present invention provides a method of storing at least one garment fastening item located on a garment having a collar support member, wherein the method comprises the steps of removing the collar support member from the garment, removing the least one garment fastening item from the garment, and attaching the at least one garment fastening item to the collar support member.

DETAILED DESCRIPTION

Figure 1:
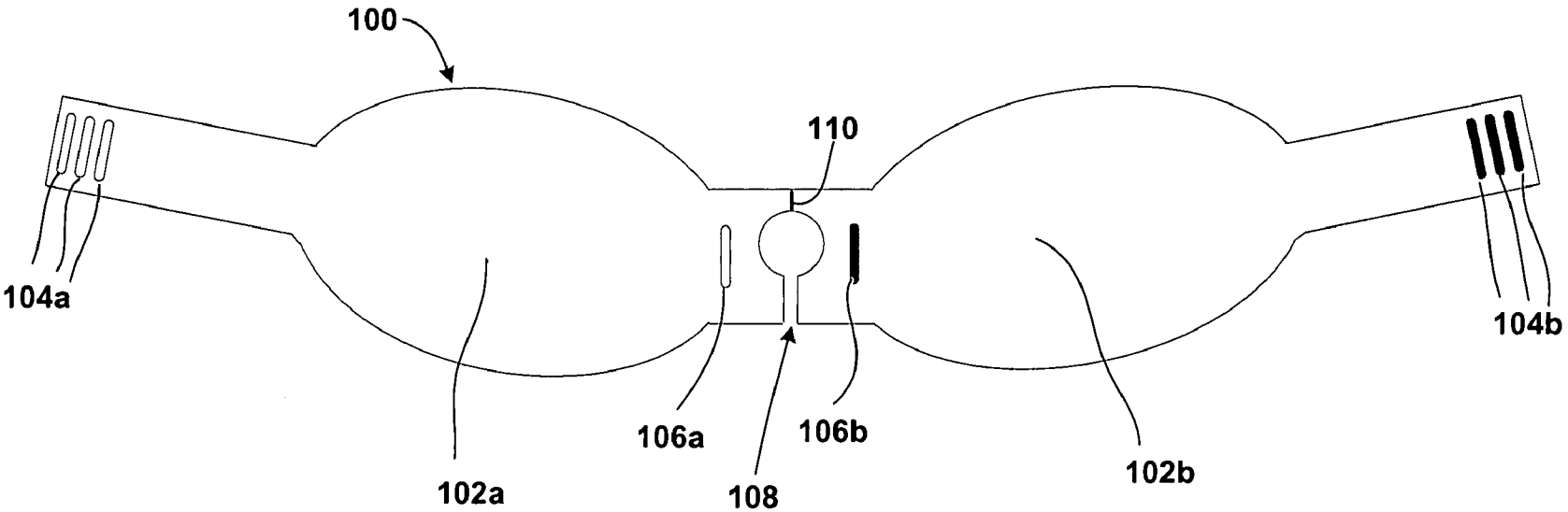
FIG. 1 illustrates a garment collar support member according to an aspect of the present invention.

FIG. 1 illustrates an embodiment of an aspect of the present invention, where a garment collar support member 100 comprises first collar shaping region 102*a*, second collar shaping region 102*b*, securing members 104*a*, 104*b*, 106*a*, and 106*b*, garment button receiving opening 108, and coupling grove 110. The first and second collar shaping regions 102*a*, 102*b* are shaped to substantially form non-planer surfaces, such that when both shaping regions 102*a*, 102*b* are folded on top of each other, a hollow area or housing region is formed between the two surfaces for storing items (e.g., pins, clips, fasteners, etc.). The non-planer surfaces may, for example, have a concave shape, so that upon folding of the first and second collar shaping regions 102*a*, 102*b* with respect to one another, a housing is formed between the concave surfaces. However, the non-planer surfaces may also be shaped in any manner that provides a housing region between the non-planer surfaces, whereby various fastening items that are used in association with the garment may be stored.

The securing members 104*a*, 104*b*, 106*a*,106*b*, and coupling grove 110 form a coupling system for both folding the first and second collar shaping regions 102*a*, 102*b* and securing them in a closed position once they are folded with respect to each other. Securing members 104*a* and 104*b* form a complementary snapping mechanism for locking the ends of the collar support member 100 in the closed position. Members 104*a* comprise three recessed regions, while members 104*b* include three protruding regions. In use, the three recessed regions receive the three complementary protruding regions.

Similarly, securing members 106*a* and 106*b* comprises a complementary recess and protruding pair, which are adjacent the button receiving opening 108. In use, the recess region receives the protruding region for the purpose of locking the central region of the collar support member 100 in the closed position. Securing members 104*a*, 104*b*, 106*a*, and 106*b* are for illustrative purposes only, and any other know method or means may be used to retain shaping regions 102*a* and 102*b* in the closed position. Thus, once in the closed position, any items or garment fastening items stored in the housing region between the regions are safely retained.

Figure 2A:
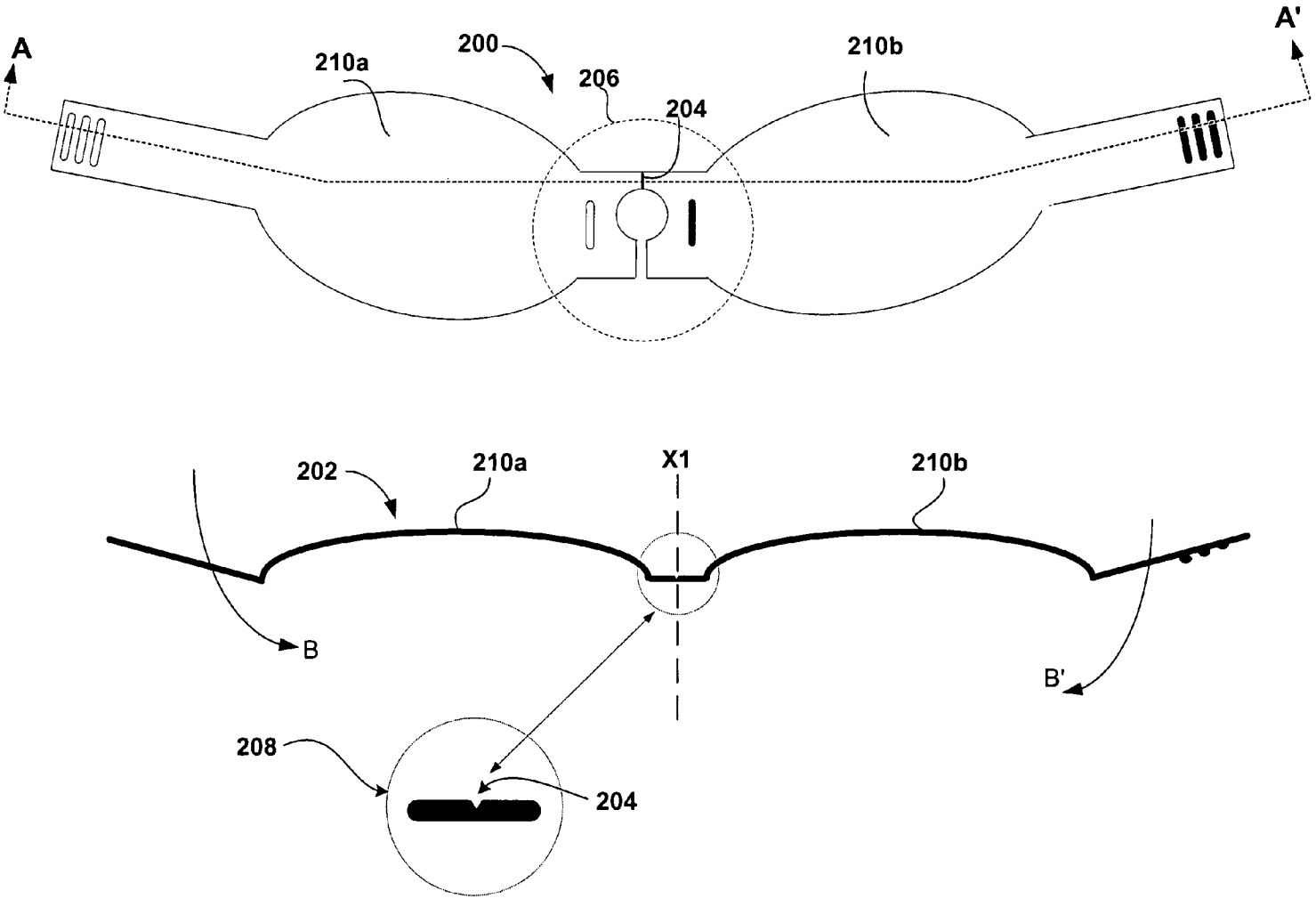
FIG. 2*a* illustrates a cross sectional view across A-A' of the collar support member shown in FIG. 1 according to an aspect of the present invention.

FIG. 2*a* illustrates the folding process of the collar support member 200 according to an aspect of the present invention. As illustrated in the figure, a cross sectional view of the collar support along A-A' is shown. Coupling grove 204 provides a means for folding the collar support member 200 about its central region 206. As shown in the cross sectional view 202, the collar support member is folded about axis X1 in the direction of arrows B and B'. Exploded view 208 illustrates a cross section of the coupling grove 204, whereby the V-shaped grove facilitates the folding of the first and second collar shaping regions 210*a* and 210*b* with respect to each other.

Figure 2B:
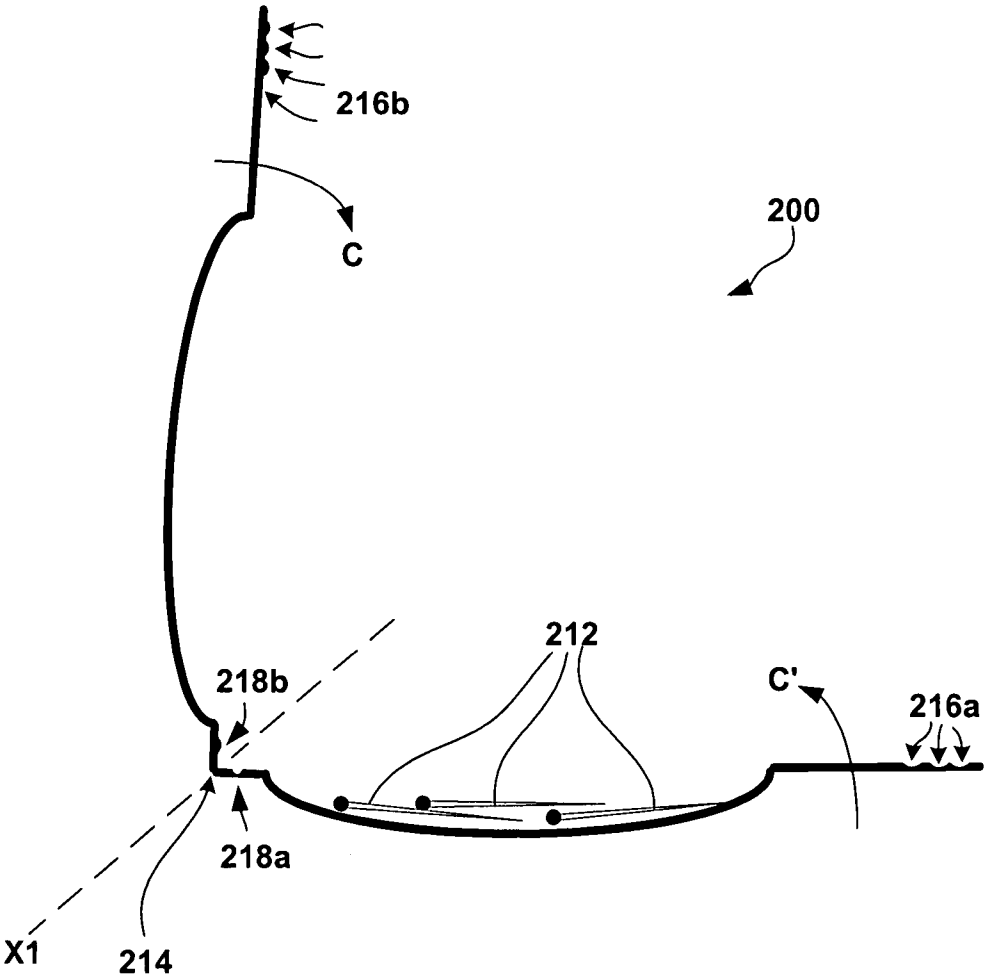
FIG. 2*b* illustrates the garment collar support member, in use, for storing fastening items, according to an aspect of the present invention.

FIG. 2*b* illustrates the collar support member 200, in use, according to an aspect of the present invention. Once the first and second collar shaping regions 210*a* and 210*b* are folded about the X1 axis, the recessed non-planer shape of either collar shaping region may be used to accommodate the storage of fastening items such as pins 212. The V-shaped grove 214 of coupling grove 204 provides a means for folding the collar support member 200, such that securing members 216*a* and 216*b* are aligned in a manner that allows them to snap together in a complementary way. As illustrated, the first and second collar shaping regions 210*a* and 210*b* are folded in the direction of arrows C and C', about axis X1.

Figure 2C:
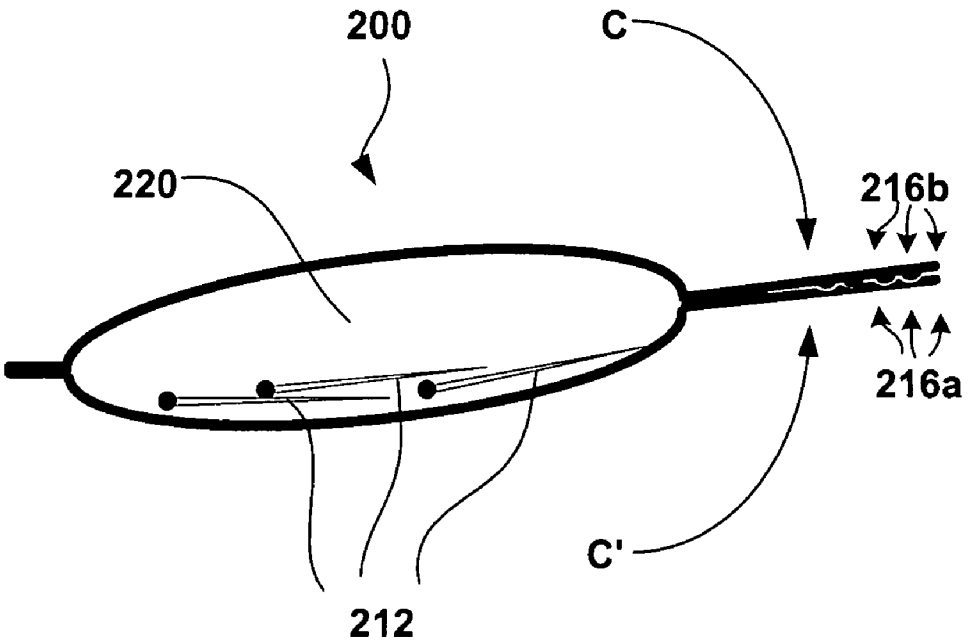
FIG. 2*c* illustrates the garment support member manipulated in the closed position for storing the fastening items, according to the present invention.

As shown in FIG. 2*c*, the folding process continues until securing members 216*a* and 216*b* are snapped together. Once securing members 216*a* and 216*b* are snapped together, pins 212, or other fastening items, are stored in housing region 220. FIG. 2*b* also illustrates securing members 218*a* and 218*b*, which are additional securing means for maintaining collar support member 200 in the closed position (FIG. 2*c*). As previously described, any securing means known to one of skill in the art may be utilized for maintaining this closed position, such that pins 212 and/or other fastening items remain in housing 220, and do not spill out.

By storing these items, there is a reduced risk of injury, which invariable occurs as a result of stepping on these items as they are removed from garments, and inadvertently end up on the floor under a person's feet. Storing pins and other fastening items in such a manner also encourages the recycling of both the collar support members and the pins or fastening items attached and/or housed within them. In addition to the hazards of stepping on these sharp and potentially dangerous fastening items, they should also be safely secured or stored in order to avoid being ingested by younger members, such as babies, or anybody that is incapable of discerning such dangers. Even if a fastening item is not particularly sharp, if ingested, it may still choke a child or person.

Although there are many different means by which these fastening items may be disposed, according to the embodiments of the present invention, a device and method is provided for immediately reminding and facilitating the safe and effective removal of a garment's fastening items from harms way.

Figure 3A:
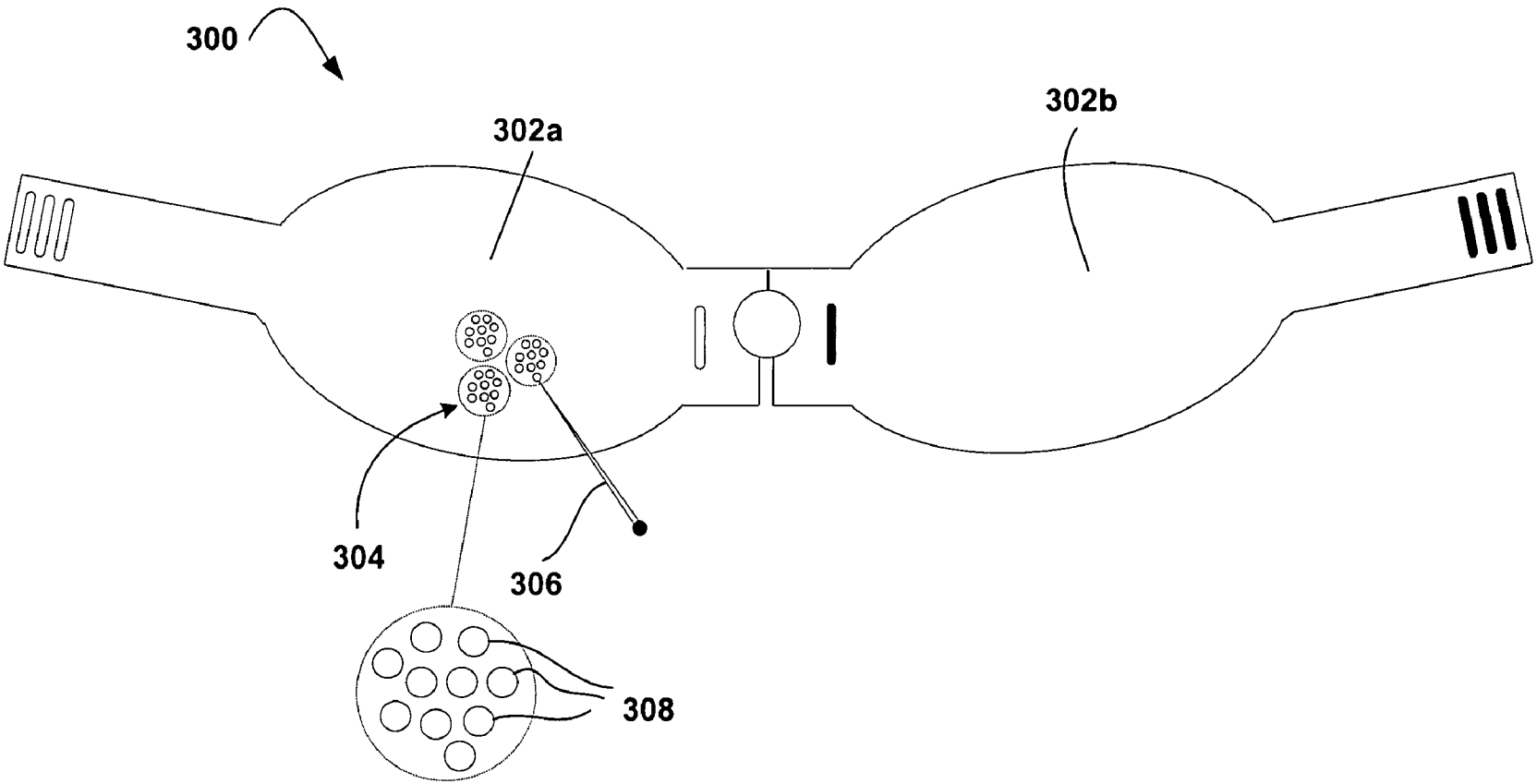
FIG. 3*a* illustrates the garment support member according to another embodiment of an aspect of the present invention for securing fastening items using a securing means.

FIG. 3 illustrates collar member 300 according to another aspect of the present invention. As illustrated, the first and second collar shaping regions 302*a* and 302*b* may comprise a plurality of openings 304 for inserting fastening items, such as pin 306. An exploded view of the plurality of openings 304 illustrates each opening 308, where each pin 306 is pushed through an opening 308 for the purpose, without limitation, of securing pin 306 to collar member 300 and, therefore, avoiding misplacing it in an undesirable location such as, for example, a floor, or a bed, etc. The first and second collar shaping regions 302*a* and 302*b* may be non-planer shaped, as described in relation to FIGS. 1 and 2.

Alternatively, first and second collar shaping regions 302*a* and 302*b* may be substantially planer shaped and include openings 304 as a means of securing fastening items, such as pin 306. If the first and second collar shaping regions 302*a* and 302*b* are planer shaped, they are not folded in order to produce a housing for storing and securing fastening items. Hence, securing means such as opening 304 are used to secure pins and other fastening items.

According to another aspect of the present invention, the collar support member 300 may comprise other securing means by providing, for example, a magnetic coating (not shown) on either or both the first and second collar shaping regions 302*a* and 302*b*. The magnetic coating is then used, among other things, for securing metallic fastening items, such as pins, to the surfaces of either or both collar shaping regions 302*a* and 302*b*.

According to yet another aspect of the present invention, the collar support member 300 may comprise an adhesive (not shown) region that is applied to the outer surfaces of either or both the first and second collar shaping regions 302*a* and 302*b*. The adhesive is then used, among other things, for adhering fastening items, such as pins and clips, to the surfaces of either or both collar shaping regions 302*a* and 302*b*.

The adhesive region may include a backing that is removed after the collar support member is removed from the shirt or garment. This avoids the adhesive from coming into contact with the collar material or other parts of the garment in question. The backing also maintains the strength of the adhesive, which may significantly diminish as various objects and surfaces come into contact with the adhesive and are then subsequently removed.

Figure 3B:
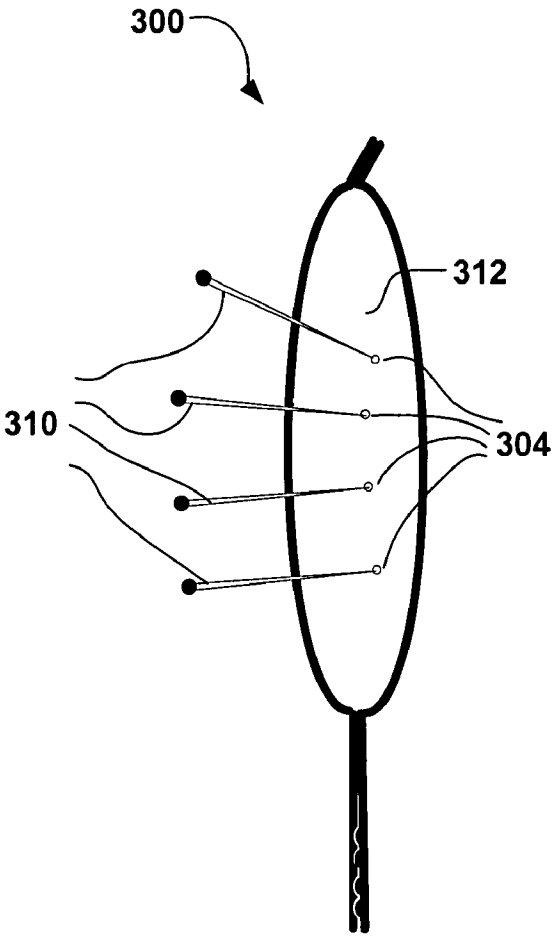
FIG. 3*b* illustrates the garment support member shown in FIG. 3*a*, wherein the support member is manipulated into the closed position.

FIG. 3*b* illustrates collar support member 300, where collar shaping regions 302*a* and 302*b* are non-planer shaped and produce a housing 302. In the illustrated aspect of the invention, fastening items such as pins 310 may either be secured by being pushed into opening 304, or as described and illustrated in relation to FIG. 2, they may be stored in housing region 312.

Figure 4:
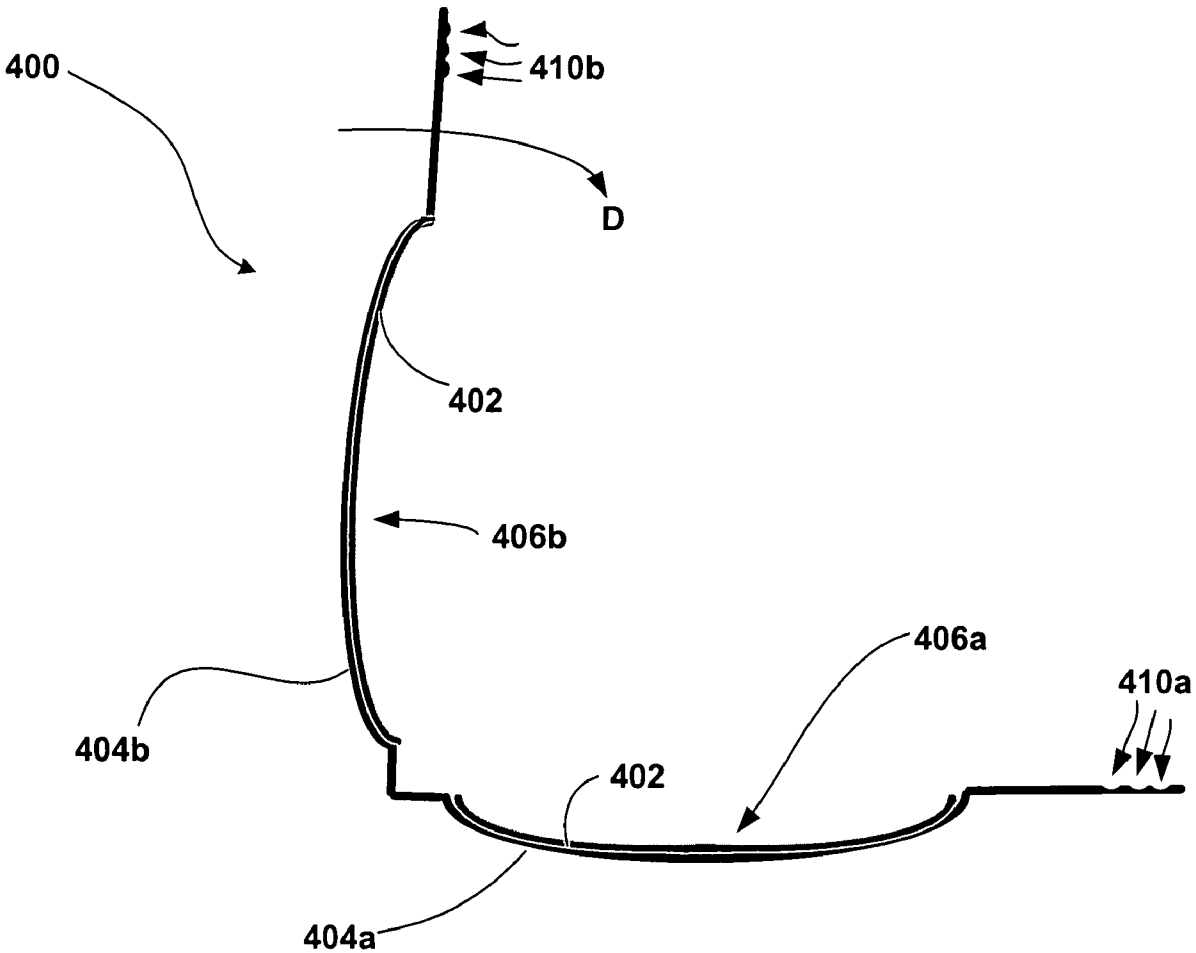
FIG. 4 illustrates the garment support member according to an aspect of the present invention, wherein the garment support incorporates an adhesive for securing the fastening items within the housing of the support member.

FIG. 4 illustrates another embodiment of an aspect of the present invention, where collar support member 400 comprises an adhesive coating 402, which is applied to the inner surfaces of either or both the first and second collar shaping regions 404*a* and 404*b*. The adhesive is then used, among other things, for adhering fastening items, such as pins and clips (not shown), to the inner surfaces 408 of either or both collar shaping regions 404*a* and 404*b*. As the fastening items are placed within the recess region 406*a* of one of the shaping regions, e.g., shaping region 404*a*, the adhesive 402 holds the fastening items within the recess region 406*a* in order to avoid any of the fastening items from falling from shaping region 404*a*. Once the fastening items are placed in the recess region 406*a*, shaping region 404*b* is closed in the direction of arrow D until securing members 410*a* and 410*b* engage each other, and collar support member 400 is placed in the closed position. The fastening items are then stored in the housing region between the recess regions of both shaping regions 404*a* and 404*b*.

Figure 5A:
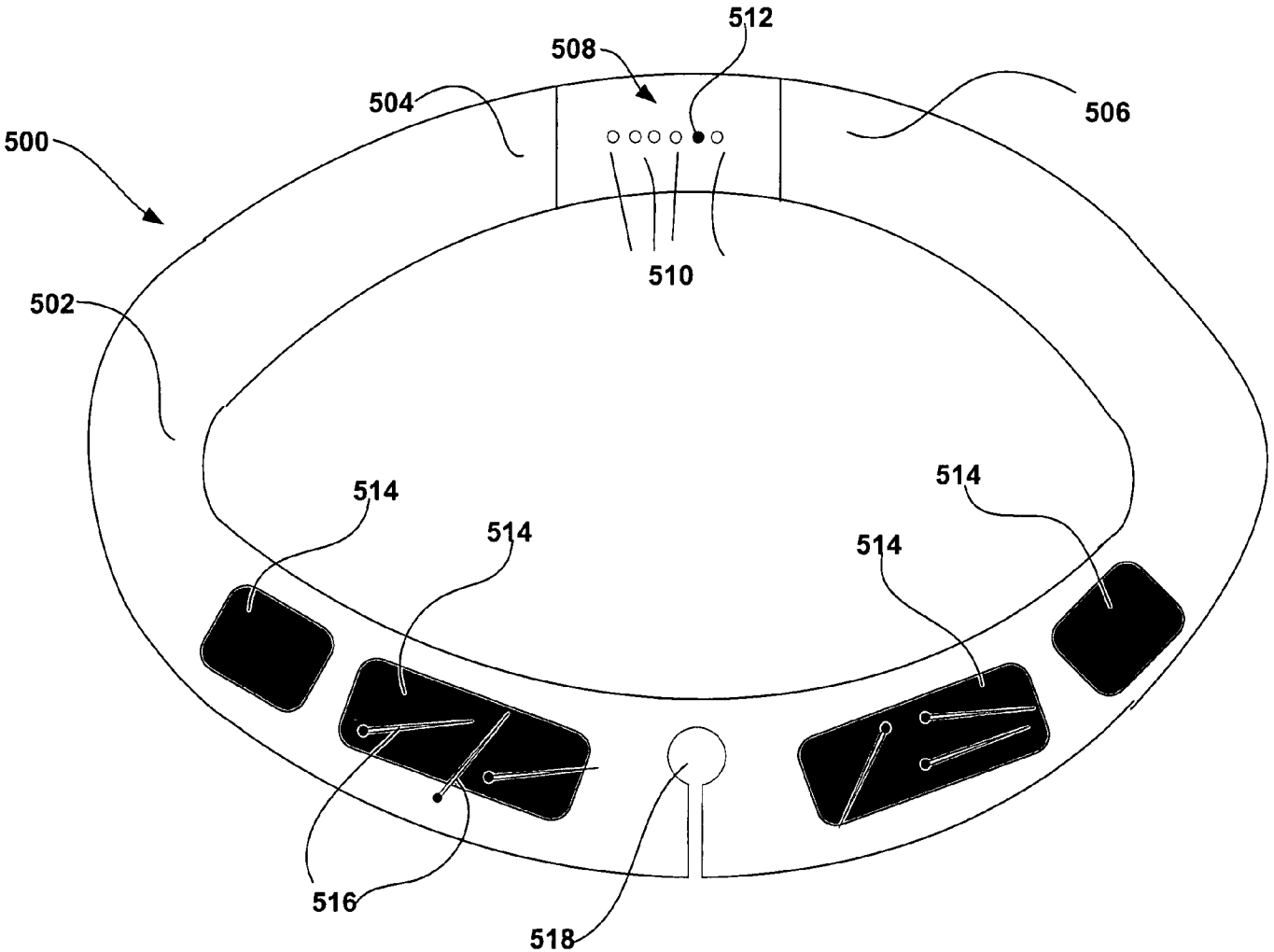
FIG. 5*a* illustrates a collar support member according to alternative embodiment of an aspect of the present invention, wherein the support member adhesively secures a plurality of fastening items to the surface of the collar support member.

FIG. 5*a* illustrates a collar support member according to an alternative embodiment of the present invention. The collar support member 500 comprises an elongate strip 502 having end portions 504 and 506, which are adjustably coupled to each other by coupling means 508. Coupling means 508 comprises attachment receptacle pairs 510 and 512 which provides a means for adjusting the length of the elongate strip 502 to substantially the same length as the length of the collar (not shown) to which it is attached. Coupling 508 may comprise other coupling means known to those of skill in the art for adjusting the length of an elongate member, such as strip 502.

The surface of the elongate strip 502 may comprise adhesive regions 514 to which fastening items, such as, for example pin items 516 are attached. Collar support member 500 also comprises button receiving means 518 for being attached to the top button (not shown) of a garment such as a shirt (not shown).

Figure 5B:
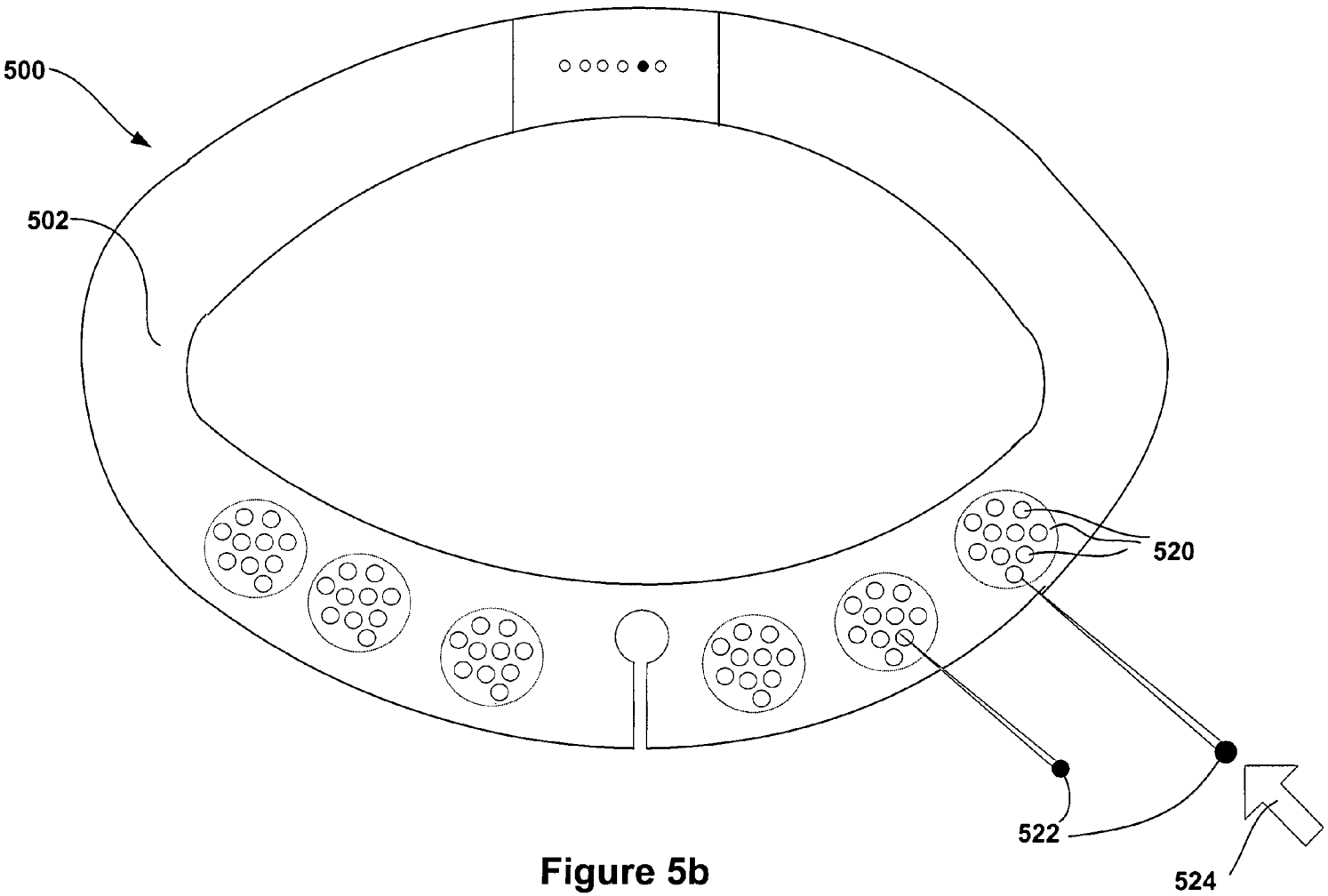
FIG. 5*b* illustrates a collar support member according to alternative embodiment of an aspect of the present invention, wherein the support member comprises through holes for securing a plurality of fastening items to the surface of the collar support member

Alternatively, as illustrated in FIG. 5*b*, a plurality of openings, such as through-holes 520 may be formed on the elongate strip 502 of the collar support member 500 for securing fastening items. The fastening items may have been removed from a garment to which the collar support member 500 was attached. Alternatively, the fastening items may have been removed from another garment. In order to secure fastening items, such as pins 522, to the elongate strip 502, the pins 522 are pushed through the holes 520, as shown by arrow indicator 524. By securing the fastening items (e.g., pins 522) to the elongate strip, the potential hazard of these items falling on the floors and/or furniture is removed. Hence disposal or recycling of the fastening items is also facilitated.

Figure 6:
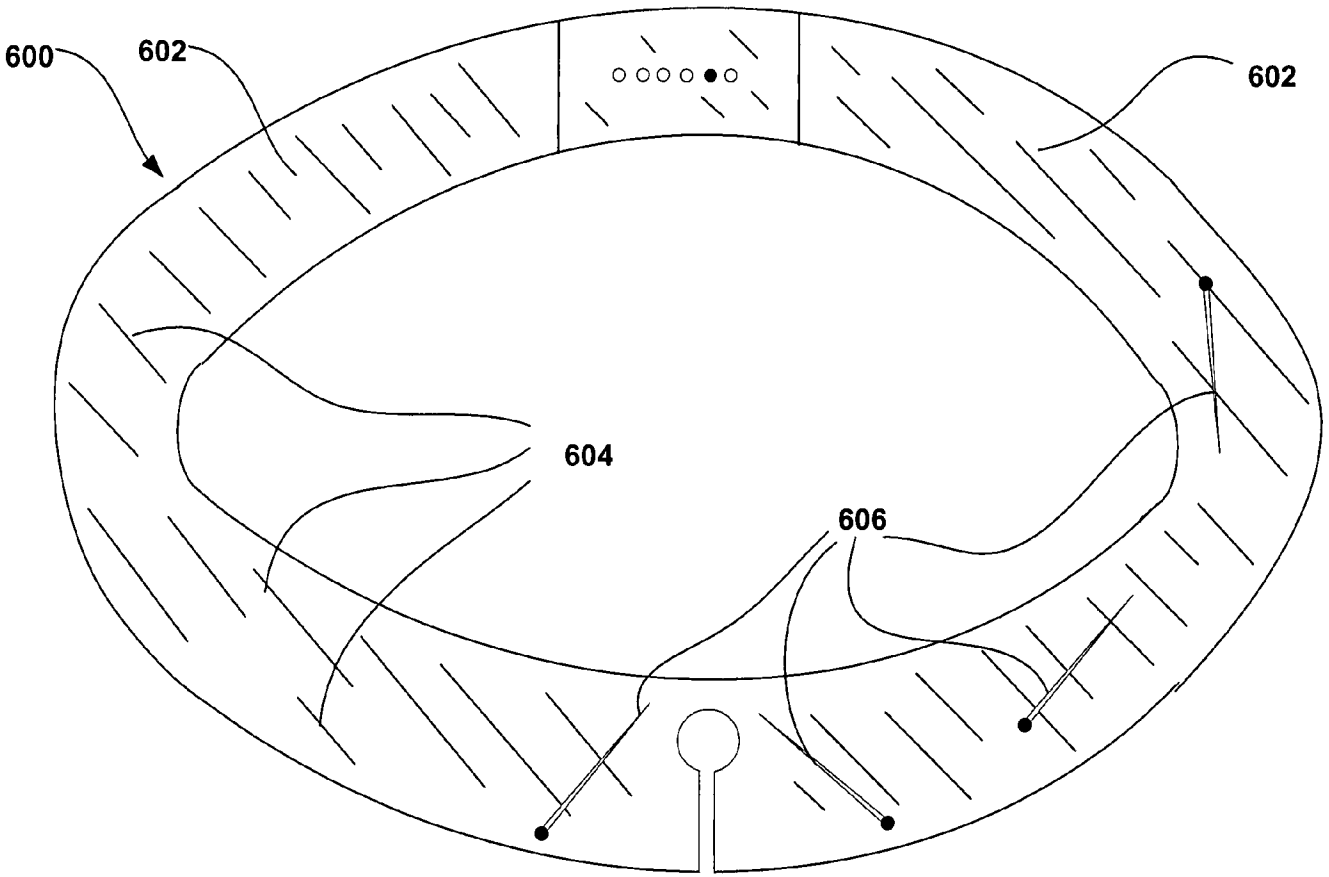
FIG. 6 illustrates a collar support member according to alternative embodiment of an aspect of the present invention, wherein the support member magnetically secures a plurality of fastening items to the surface of the collar support member.

FIG. 6 illustrates a collar support member 600 comprising an elongate strip 602 and a magnetic coating 604 according to an aspect of the present invention. The magnetic coating 604 is applied to the elongate strip 602, where the magnetic coating is used for securing metallic fastening items, such as pins 606, to the surface of the elongate strip 602. Other fastening items may similarly be attached to elongate strip 602 by means of the magnetic coating 604.

According to another aspect of the present invention, the illustrated embodiments also provide a means for recycling the fastening items as well providing the safety aspects described above.

In addition to the embodiments of the aspects of the present invention described above, those of skill in the art will be able to arrive at a variety of other arrangements and steps which, if not explicitly described in this document, nevertheless embody the principles of the invention and fall within the scope of the appended claims. For example, the ordering of method steps is not necessarily fixed, but may be capable of being modified without departing from the scope and spirit of the present invention.

What is claimed is:

1. A garment collar support member for shaping a garment collar, the garment collar support member comprising:

(a) a first collar shaping region adapted to support a first collar associated with the garment collar, the first collar shaping region comprising a first non planar surface;

(b) a second collar shaping region adapted to support a second collar associated with the garment collar, the second collar shaping region comprising a second non planar surface; and (c) a coupling system associated with coupling the first and second collar shaping region together for providing a housing region between the first and second non-planar surface, wherein the housing region stores at least one fastening item.

2. The garment collar support member according to claim 1, further comprising a garment button-receiving opening for removeably attaching the garment collar shaping item to a button of a garment, wherein the garment button-receiving opening is adjacent to the first and second non planer surface.

3. The garment collar support member according to claim 1, wherein the first non-planer surface comprises an adhesive for securing the at least one fastening item to the first collar shaping region.

4. The garment collar support member according to claim 1, wherein the second non-planer surface comprises an adhesive for securing the at least one fastening item to the second collar shaping region.

5. The garment collar support member according to claim 2, wherein the coupling system comprises a grove region located adjacent to the garment button-receiving opening for folding the first and second collar shaping region onto each another and providing the housing region.

6. The garment collar support member according to claim 5, wherein the coupling system comprises at least one securing member for maintaining a closed relationship between the folded first and second collar shaping regions that provide the housing therebetween.

7. The garment collar support member according to claim 1, wherein the first and second non planar surface are substantially parabolic shaped.

8. The garment collar support member according to claim 1, wherein the first non-planer surface comprises a plurality of openings for receiving at least one of the group consisting of pins and securing objects.

9. The garment collar support member according to claim 1, wherein the second non-planer surface comprises a plurality of openings for receiving at least one of the group consisting of pins and securing objects.

10. A method of storing at least one garment fastening item, the method comprising the steps of:

(a) providing a collar support member having a first and a second non-planer surface;

(b) inserting the at least one garment fastening item into a recess associated with the first non-planer surface; and (c) folding the second non-planer surface onto the first non-planer surface for providing a housing therebetween, wherein the at least one garment fastening item is located in the housing.

11. The method according to claim 10, further comprising securing the first and second non-planer surface with respect to each other in order retain the at least one garment fastening item within the housing.

12. The method according to claim 10, further comprising inserting at least one pin item into at least one opening located on an outer surface of the first non-planer surface.

13. The method according to claim 10, further comprising inserting at least one pin item into at least one opening located on an outer surface of the second non-planer surface.

14. The method according to claim 10, wherein the first non-planer surface comprises an inner surface having an adhesive for adhering the at least one garment fastening item to the inner surface.

15. The method according to claim 10, wherein the second non-planer surface comprises an inner surface having an adhesive for adhering the at least one garment fastening item to the inner surface.

16. The method according to claim 1, wherein the first and second non planar surface are substantially parabolic shaped.

17. A method of storing at least one garment fastening item located on a garment having a collar support member, the method comprising the steps of:

(a) removing the collar support member from the garment;

(b) removing the least one garment fastening item from the garment; and (c) attaching the at least one garment fastening item to the collar support member.

18. The method according to claim 17, wherein attaching the at least one garment fastening item to the collar support member comprises adapting the collar support member to provide a housing for storing the at least one garment fastening item.

19. The method according to claim 18, wherein the at least one garment fastening item is adhered within the housing of the collar support member.

20. The method according to claim 17, wherein attaching the at least one garment fastening item to the collar support member comprises inserting the at least one garment fastening item into at least one opening associated with the collar support member.

* * * * *